US007060407B2

(12) United States Patent
Nagayama et al.

(10) Patent No.: US 7,060,407 B2
(45) **Date of Patent: *Jun. 13, 2006**

(54) IMAGE REMOVING METHOD, IMAGE REMOVING DEVICE, AND IMAGE FORMING APPARATUS

(75) Inventors: Masashi Nagayama, Numazu (JP); Motoharu Tanaka, Mishima (JP); Toyoshi Sawada, Odawara (JP); Keiko Shiraishi, Susono (JP); Tadashi Saitoh, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 161 days.

This patent is subject to a terminal disclaimer.

(21) Appl. No.: 10/677,346

(22) Filed: Oct. 3, 2003

(65) Prior Publication Data

US 2004/0121254 A1 Jun. 24, 2004

(30) Foreign Application Priority Data

Oct. 4, 2002 (JP) ..... 2002-292063

(51) Int. Cl.
*G03G 13/20* (2006.01)

(52) U.S. Cl. ..... 430/97; 430/108.1; 430/108.11; 430/108.2; 430/108.4

(58) Field of Classification Search ..... 430/97, 430/108.1, 124, 108.11, 108.2, 108.4; 399/341, 399/411

See application file for complete search history.

(56) References Cited

U.S. PATENT DOCUMENTS

| | | | | |
|---|---|---|---|---|
| 5,863,697 | A * | 1/1999 | Uchiyama et al. | 430/137.17 |
| 6,913,860 | B1 * | 7/2005 | Mochizuki et al. | 430/19 |

FOREIGN PATENT DOCUMENTS

| | | |
|---|---|---|
| JP | 1-297294 | 11/1989 |
| JP | 4-67043 | 3/1992 |
| JP | 4-356086 | 12/1992 |
| JP | 6-222604 | 8/1994 |
| JP | 7-311523 | 11/1995 |
| JP | 8-146647 | 6/1996 |
| JP | 8-146648 | 6/1996 |
| JP | 8-146649 | 6/1996 |
| JP | 8-146650 | 6/1996 |
| JP | 2584112 | 2/1997 |
| JP | 11-174709 | 7/1999 |
| JP | 2960229 | 10/1999 |
| JP | 2000-267525 | 9/2000 |

* cited by examiner

*Primary Examiner*—John L Goodrow
(74) *Attorney, Agent, or Firm*—Oblon, Spivak, McClelland, Maier & Neustadt, P.C.

(57) ABSTRACT

An image removing method including bringing an outermost layer of a removing member into contact with an image fixed on an image support without applying a liquid to the image while heating the image and the outermost layer; and separating the removing member from the image support to remove the image from the image support, wherein the removing member includes a substrate and the outermost layer which is located overlying the substrate and which includes a thermoplastic resin, and wherein the image includes a removing agent which can decrease adhesion force of the image to the image support when heated.

9 Claims, 4 Drawing Sheets

IMAGE REMOVING METHOD, IMAGE REMOVING DEVICE, AND IMAGE FORMING APPARATUS

BACKGROUND OF THE INVENTION

1. Field of the Invention

The present invention relates to an image removing method, and more particularly to an image removing method by which an image formed on an image support by a method such as electrophotographic recording, inkjet recording and thermal recording can be removed so that the image support can be reused. In addition, the present invention also relates to an image removing device, and an image forming apparatus which can produce an image having good fixability, wherein the image can be removed from the image support when heated.

2. Discussion of the Background

Currently, a huge amount of hard copies are produced to distribute information. In such hard copies, images are formed by an image forming method such as printing (e.g., relief printing and planograph), electrophotographic recording, inkjet recording and thermal recording, or a writing material such as crayons and marker pens. Among these images, toner images formed by electrophotographic recording have advantages in that various image supports can be used, running costs are low when plain paper is used as an image support, and images can be formed at a high speed.

However, as a result of production of such a huge amount of hard copies, a large amount of paper is consumed, resulting in destruction of environment due to deforestation.

In order to prevent destruction of environment, only a method in which papers having images thereon are recycled by removing the image forming materials from the papers and using the used papers for forming a recycle paper has been used. On the other hand, methods in which images formed on papers are removed by cleaning so that the papers are reused for image forming have been proposed recently. In particular, various image removing methods have been proposed for images produced by electrophotographic methods by which a relatively large amount of paper is consumed.

The image removing methods in the electrophotographic field are broadly classified into methods in which image supports (e.g., papers and overhead projection sheets) are improved to easily remove images thereon; methods in which image forming materials are improved to easily remove images thereon; and methods in which images are removed using a material such as image removing liquids or image removing members.

Specifically the following methods have been disclosed:

(a) methods in which a water-swelling material formed of a crosslinked hydrophilic resin is formed on a support as a water-swelling layer and images thereon are removed by wetting the water-swelling layer with water (disclosed in published unexamined Japanese patent applications Nos. (hereinafter referred to as JOPs) 07-311523, 06-222604 and 11-174709); and (b) methods in which an erasable paper whose surface is subjected to a releasing treatment is used as a support so that toner images formed thereon are easily removed (disclosed in JOP 04-067043).

However, these methods have a disadvantage such that a special paper has to be used as an image support, and thereby the above-mentioned advantages of electrophotographic recording are lost.

In addition, the following methods have also been proposed:

(c) a toner constituted of a material which can be discolored by a photochemical method, such as cyanine dyes and ammonium salts of organic boric acid, is used as the image material (disclosed in Japanese patent No. 2960229);

(d) a toner including a degradable material such as biodegradable plastics and photodegradable plastics is used as the image material (disclosed in JOP 04-356086); and However, these methods have disadvantages in that resin components in the discolored toner images remain on the surface of a support, and thereby the surface roughness of the support is seriously deteriorated compared to the original support (for the method (c)); the images have poor color reproducibility because limited materials are used for the toner (method (c)); and when biodegradable materials are used, it is impossible to perfectly remove toner images if a large amount of toner is adhered to an image support (method (d)).

In addition, the following methods have been proposed.

(e) methods in which a toner image including a resin is removed by an image removing liquid including a component which can swell the resin, wherein the hydroxyl value and acid value of the swelling resin are specified (JOP 08-146648), the surface area of the toner is specified (JOP 08-146650), and a hydrophilic particulate material is included as the resin (JOP 08-146647), and a surfactant is included in a toner to enhance the penetrating property of the image removing liquid into the toner (JOP 08-146649).

The methods (e) disclosed in JOPs 08-146647-146650 in which an image removing liquid including a component dissolving or swelling a resin included in the toner is used has the following drawbacks:

(1) it is not preferable in view of safety that the removing liquid includes a solvent dissolving or swelling a resin; and (2) since papers serving as an image support absorb the removing liquid or are swelled by the removing liquid, the papers are stretched even after dried, and thereby a problem such as jamming occurs when the papers are reused.

The present inventors checked the releasing effect of the surfactant-including toner disclosed in JOP 08-146649 without using a removing liquid. As a result, the toner does not have a releasing function by itself, namely it is difficult to remove toner images by a dry method. This is because the toner images do not absorb the image removing liquid.

In addition, a proposal such that in order to weaken an interface between an image and an image support, a surfactant is included in the image forming material or the image support is made. Although it is possible to remove images by the method, the adhesion between the image removing member and the image is weak, and therefore the method cannot be practically used.

Specific examples of the methods in which images are removed using an image removing member include the following:

(f) a force is applied to an image and an image support using an image removing member such as brushes and removing blades;

(g) an image removing member is overlaid on an image and both are heated so that an adhesion force is provided therebetween, resulting in adhesion of the image to the image removing member;

(h) the adhesion between an image and an image support is weakened using an image removing liquid or the like and the image is removed by a directly or indirectly removing method. At this point, the direct removing method means that, for example, a toner image fixed on a paper support is scraped off, and the indirect removing method means that, for example, a toner image is transferred to an image removing member, and the image on the image removing member is scraped off.

When images are removed by a direct or indirect removing method without weakening the adhesion between the image and the support, it is difficult to perfectly remove the images. In this case, if the images are forcibly removed, the support is damaged, which is not preferable in view of reuse of the support.

The methods using an image removing liquid are preferable because of not damaging the support and the image removing rate can be dramatically improved. However, in the methods a shear force is caused between a paper support and a toner image by applying the image removing liquid to reduce the adhesion force therebetween. In this case, the paper support is swelled and therefore the paper support is stretched. Therefore, a problem such as paper jamming tends to occur when the paper support is reused. In addition, a solid toner image having a large area cannot be well removed because the resins included in toner images are typically insoluble in water or are not swelled by water. Therefore even an image removing liquid including a surfactant cannot penetrate into such a solid toner image, and thereby the solid toner image cannot be well removed. If a solid toner image on a support is dipped into an image removing liquid, the toner image is fairly removed, but the above-mentioned problem in that the paper support is swelled and therefore the paper support is stretched, resulting in occurrence of paper jamming occurs.

JOP 01-297294 discloses a method in which a thermofusible image removing material is contacted with an image formed on an image support using a thermofusible ink while applying heat thereto, and then a removing substrate is overlaid thereon followed by cooling, resulting in removal of the thermofusible ink image from the image support.

Japanese patent No. 2,584,112 (i.e., JOP 04-64472) discloses an eraser which is prepared by forming a thermofusible resin layer on a substrate and which can remove a toner image formed on an erasable paper by contacting the erasable paper while heating the thermofusible resin layer.

JOP 2000-267525 discloses an image forming material removing device which is prepared by forming an image removing layer consisting of a thermofusible resin on a substrate and which can remove an image forming material adhered to an image support by contacting the image removing layer with the image forming material upon application of heat thereto such that the image forming material adheres to the image removing layer.

However, these methods have a drawback in that the adhesive force between the image forming material and the image support is so strong that the image forming material is broken and thereby the image cannot be perfectly removed, or the image support is broken, and thereby the image support cannot be reused.

Because of these reasons, a need exists for an image removing method by which images on a paper support can be removed to reuse the image support without using an image removing liquid or the like.

SUMMARY OF THE INVENTION

Accordingly, an object of the present invention is to provide an image removing method by which an image formed on a paper support can be well removed without using an image removing liquid (i.e., without swelling the paper support) and without damaging the paper support.

Another object of the present invention is to provide an image removing device which can remove an image formed on a paper support without using an image removing liquid and without damaging the paper support.

Yet another object of the present invention is to provide an image forming apparatus which can produce an image fixed on a paper support, wherein the image can be removed from the paper support, if desired.

A further object of the present invention is to provide a toner image which is fixed on an image support but can be removed therefrom when heated.

Briefly these objects and other objects of the present invention as hereinafter will become more readily apparent can be attained by an image removing method which includes:

bringing an outermost layer of an image removing member into contact with an image support having an image thereon without applying a liquid to the image, while heating the image and the image removing member; and separating the removing member from the image support to remove the image from the image support, wherein the removing member includes a substrate and the outermost layer which is located overlying the substrate and which includes a thermoplastic resin, and wherein the image includes a removing agent which can decrease the adhesion force of the image to the image support when heated.

The image preferably includes a thermoplastic resin as a main component and/or a material having a lipophilic group. The resin is preferably the same as the resin in the outermost layer. Alternatively, the image and the outermost layer include a same material.

The image preferably includes the removing agent as an internal additive or an external additive to decrease the adhesive force of the image to the image support when heated.

Alternatively, the image forming material (e.g., a toner) may include a particulate material, to which the removing agent is added, as an internal additive or an external additive.

Alternatively, the image forming material may include a particulate material, which is a clathrate including the removing agent therein, as an internal additive or an external additive.

Each of the removing agent and the particulate material has a hydrophilic group and the hydrophilic groups form a salt with ionic bonding and/or hydrogen bonding.

The temperature at the heating is preferably higher than the fixing temperature at which the image has been fixed on the image support.

As another aspect of the present invention, an image removing device is provided which includes an image removing member, and a heating member which heats the image removing member to heat an image on an image support, wherein the image removing device uses the image removing method mentioned above.

The image removing device preferably has a renewing member configured to renew the image removing member.

As yet another aspect of the present invention, an image forming apparatus is provided which includes:

a charger configured to charge an image bearing member, a light irradiator configured to irradiate the image bearing member with light to form a latent image on the image bearing member;

a developing device configured to develop the latent image with a developer including a toner to form a toner image on the image bearing member;

a transfer device configured to transfer the toner image on an image support paper; and a fixer configured to fix the toner image on the image support paper, wherein the toner includes a removing agent.

In addition, the image forming apparatus may further include the image removing device of the present invention.

The image forming apparatus may further include a device configured to produce the image removing member by forming an outermost layer including a thermoplastic resin on an image support.

As a still further aspect of the present invention, a toner image is provided which is fixed on an image support at a fixing temperature and which includes at least a binder resin, a colorant and a removing agent configured to decrease an adhesive force of the toner image to the image support when the toner image is heated at a temperature higher than the fixing temperature.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
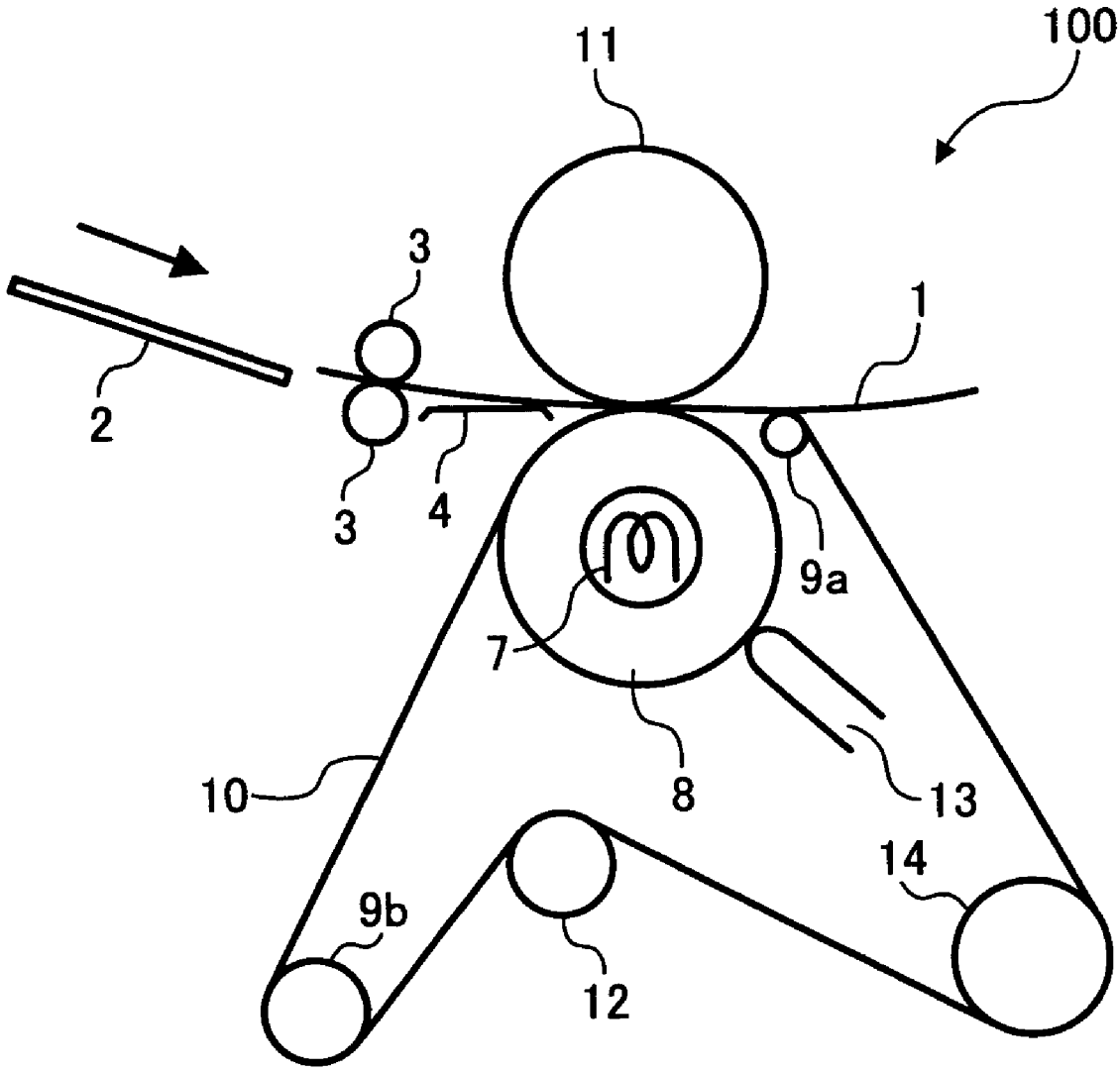
FIG. 1 is a schematic view illustrating an example of the image removing device of the present invention.

The present invention relates to an image removing method which includes:

bringing an outermost layer of a removing member into contact with an image fixed on an image support without applying a liquid to the image while heating at least the image and the outermost layer to soften the image and to generate an adhesive force between the image and the outermost layer, wherein the outermost layer includes a thermoplastic resin; and separating the image removing member from the image support to remove the image from the image support, wherein the image removing member includes a substrate and the outermost layer located overlying the substrate, and wherein the image includes a removing agent which can decrease the adhesion force of the image to the image support when heated.

Specifically, when the image and the outermost layer are heated, the thermoplastic resin in the outermost layer deforms and adheres to the image so as to wrap the image. Thereby, a strong adhesive force is generated between the image and the thermoplastic resin, resulting in removal of the image from the image support.

Namely, when the image is removed, the following relationship is satisfied:

$$F1>F2$$

wherein F1 represents an adhesive force of the image to the outermost layer of the image removing member, and F2 represents an adhesive force of the image to the image support.

In order to improve the adhesion of the image to the image removing member, the image preferably includes a resin, which has a solubility parameter (SP value) similar to that of the thermoplastic resin included in the outermost layer. In addition, it is preferable that the image includes a material which can reduce the adhesion force of the image to the image support when the image is heated (the material is hereinafter referred to as a removing agent). By including such a removing agent in the image, the adhesion force of the image to the image support is reduced, and thereby the image removing effect can be enhanced.

In the present invention, the adhesion force of an image to an image support is measured by a tacking tester, TACKINESS TESTER MODEL TAC-II manufactured by RHESCA CO., LTD. The adhesion force of an image to an image support at room temperature is measured as follows:

(1) a double-sided adhesive tape is attached to a probe having a diameter of 5 mm;

(2) the probe is dropped at a speed of 120 mm/min;

(3) the probe having the double-sided adhesive tape thereon is brought into contact with the image so as to press the image at a pressure of 500 gf/5 mmϕ; and (4) after pressing the image for 10 seconds, the probe is pulled up at a speed of 600 mm/min while the image support is fixed, to determine the force (i.e., the adhesion force) needed for removing the image from the image support.

The adhesion force at a high temperature is measured as follows:

(1) a removing member which is prepared by adhering a thermoplastic resin on a polyether ether ketone film (SUMILITE FS-1100C manufactured by SUMITOMO BAKELITE CO., LTD. and having a thickness of 100 μm is attached to the probe; and (2) the above-mentioned measurement procedures (2) to (4) are performed at the predetermined temperature to determine the adhesion force at the temperature.

As a result of the present inventors' experiment, it is found that when a removing agent is included in an image, the adhesion force of the image to an image support is reduced at the image removing temperature.

In the present invention, an image formed on an image support can be removed by the above-mentioned method using the image removing member to an extent such that the image hardly remains on the image support even when an image removing liquid is not previously applied thereto. Since image removing can be performed without applying a removing liquid to the image and the image support, the above-mentioned problem in that the image support paper is deformed after the removing liquid is dried and thereby the image support cannot be reused can be avoided.

In the present invention, it is preferable that when the image to be removed includes a resin, the thermoplastic resin included in the image removing member has a solubility parameter similar to that of the resin included in the image. It is most preferable that the thermoplastic resin is the same as the resin included in the image. By using such a technique, the amount of the residual image remaining on the image support can be further reduced.

When a toner image is removed from an image support, it is preferable to use the toner itself as the outermost layer of the image removing member. By using such an image removing member, the image removing member can be repeatedly used, resulting in decrease of running costs of the image removing operations. In addition, it is unnecessary to purchase and coat a thermoplastic resin to form an outermost layer, resulting in further decrease of the supplies expenses.

When a thermoplastic resin or a material including a thermoplastic resin is formed on the surface of the image removing member, it is preferable to apply the thermoplastic resin or the material including a thermoplastic resin on the surface of the image removing member upon application of heat thereto. When a toner image is removed from an image support paper, image forming units (e.g., a fixer) can be used as an applicator which applies a thermoplastic resin (i.e., a toner in this case) to the surface of the image removing member, and thereby the image forming apparatus can be miniaturized. In this case, the image removing member can be repeatedly produced in the image forming apparatus, it is unnecessary to purchase a new removing member and thereby the supplies expenses can be reduced.

It is preferable that the image includes a material having a lipophilic group. When such a material is included in the image, the image can be easily captured by the thermoplastic resin included in the image removing member, and thereby the amount of the residual image which remains on the image support without being captured can be reduced.

It is preferable that the image includes a thermoplastic resin as a main component. When a thermoplastic resin is included in the image, the anchor effect in that the thermoplastic resin serves as an anchor to the image support can be reduced when the image is heated, and thereby the removing ability of the image removing member can be effectively exerted.

In addition, it is preferable to use an image forming material including a removing agent as an internal additive or an external additive when forming an image. When a removing agent is included in an image, the image is fully adhered to the image support so as to be hardly peeled by rubbing under normal conditions. However, the image can be easily removed when heated. This is because the adhesive force of the image to the image support is reduced when the image is heated while the adhesive force of the image to the outermost layer of the image removing member, which layer includes a thermoplastic resin, increases. Therefore, the following relationship can be satisfied:

$$F1>F2$$

wherein F1 represents an adhesive force of the image to the outermost layer of the image removing member, and F2 represents an adhesive force of the image to the image support.

Alternatively, it is also preferable that a particulate material to which a removing agent is added may be included in the image forming material (e.g., a toner) as an internal additive. In this case, by mixing the particulate material with constituents of the image forming material, the removing agent can be included in the image forming material so uniformly as to be well dispersed in the resultant image. Therefore, even a solid image can be easily removed uniformly from the image support when heated.

In addition, a particulate material to which a removing agent is added may be included in the image forming material as an external additive. In this case, the removing agent can be mainly located on the surface of the resultant image, and thereby the function of the removing agent can be fully fulfilled.

Alternatively, the removing agent may be included in the image forming material (e.g., a toner) such that a particulate material which is a clathrate including a removing agent therein is included in the image forming material as an internal additive. By using such a clathrate, the removing agent can be prevented from changing its property when the image is formed by the image forming material. Therefore, the function of the removing agent can be fully exerted.

The clathrate may be included in the image developer as an external additive. In this case, the image forming material can be prevented from blocking due to deterioration of the preservability of the image forming material caused by inclusion of a removing agent, and thereby the removing agent can be prevented from being embedded into the image forming material. Thus, the effect of decreasing the adhesion force of the image to the image support can be fully exerted.

In these cases in which a removing agent is used together with a particulate material, it is preferable that the removing agent has a hydrophilic group and the hydrophilic group has an ionic bonding with a group of the particulate material to form a salt, alternatively the hydrophilic group may have a hydrogen bonding with a group of the particulate material. When the removing agent and the particulate material form such a bonding, the removing agent is captured by the particulate material during preservation, and thereby a problem in that the adhesion force of the image to the image support decreases during preservation of the image can be avoided.

In particular, when each of the particulate material and the removing agent includes a hydrophilic group, the hydrophilic groups are disabled if the hydrophilic groups form a salt or a hydrogen bonding, and thereby the moisture resistance of the particulate material and the removing agent can be improved. Namely, the removing agent can be prevented from being embedded into the image forming material due to blocking of the image forming material. Thereby, a problem in that the adhesion force of the image to the image support decreases during preservation of the image can be avoided.

In the image removing method of the present invention, it is preferable that an image is removed at a temperature higher than the fixing temperature at which the image is fixed on the image support. This is because the image can be softened like a rubber, and thereby the image can be securely captured by the thermoplastic resin located on the surface of the image removing member.

The image removing device of the present invention preferably includes a device configured to prepare an outer layer on the removing member.

In addition, the image forming apparatus of the present invention preferably has a function of the image removing device of the present invention. For example, when the image forming apparatus has a heat fixing device to fix an image on an image support, the heat fixing device can also be used as the device which prepares an outermost layer on the removing member. Thus, an image forming apparatus which has both an image forming function and an image removing function and which is small in size can be provided.

In the present invention, specific examples of the image support include papers, plastic films (e.g., overhead projection films), etc., which are used in conventional copiers and printers, but are not limited thereto. The image forming materials for use in the present invention include at least a colorant and a binder such as resins and waxes. Specific examples of the image forming materials (i.e., image developers) include toners, powder inks (for use in solid inkjet recording), thermal transfer recording inks including a wax and/or a resin, printing inks, etc.

Hereinafter the present invention will be explained in detail referring to a toner image.

Toners for use in electrophotography typically includes a thermoplastic resin, which serves as a binder resin, and a colorant as main components. The toners optionally include a charge controlling agent, a release agent, and additives which improve toner properties, such as fluidity. In addition, when a magnetic toner is prepared, a magnetic material is included in the toner. In order to improve the fluidity, the surface of toner particles can be subjected to a treatment, for example, toner particles can be mixed with an external additive.

Binder Resin

Suitable materials for use as the binder resin of the toner include known resin for use in conventional toners. Specific examples of the resins include thermoplastic resins such as styrene-acrylic resins, styrene-methacrylic resins, olefin resins, polyester resins, amide resins, polycarbonate resins, polyeter resins, polysulfone resins, epoxy resins, urea resins, urethane resins, and copolymers thereof. These resins can be used alone or in combination The number average molecular weight (Mn) of the binder resins is preferably from 6,000 to 20,000, and the ratio Mw/Mn of the weight average molecular weight (Mw) of the binder resins to the number average molecular weight (Mn) thereof is preferably from 2 to 100. However, the number average molecular weight (Mn) and the ratio (Mw/Mn) are not limited thereto if the resultant toner satisfies requirements of a toner.

Colorant

The toner for use in the present invention include a colorant. Suitable materials for use as the colorant include known colorants for use in conventional toners. Specific examples of the colorants include the following organic or inorganic pigments and dyes.

(1) Black Colorants

Carbon black, copper oxide, manganese oxide, aniline black, charcoal, non-magnetic ferrites, magnetic ferrites, magnetites, etc.

(2) Yellow Colorants

Chrome yellow, zinc yellow, Cadmium Yellow, yellow iron oxide, Mineral Fast Yellow, Nickel Titan yellow, naples yellow, Naphthol Yellow S, Hansa Yellow G, Hansa Yellow 10 G, Benzidine Yellow G, Benzidine Yellow GR, Quinoline Yellow Lake, Permanent Yellow NCG, Tartrazine Lake, etc.

(3) Orange Colorants

Red chrome yellow, Molybdenum Orange, Permanent Orange GTR, Pyrazolone Orange, Vulcan Orange, Indanthrene Brilliant Orange RK, Benzidine Orange G, Indanthrene Brilliant Orange GK, etc.

(4) Red Colorants

Red iron oxide, cadmium red, red lead, cadmium mercury red, Permanent Red 4R, Lithol Red, Pyrazolone Red, Watchung Red, calcium salts, Lake Red C, Lake Red D, Brilliant Carmine 6B, Eosin Lake, Rhodamine Lake B, Alizarine Lake, Brilliant Carmine 3B, etc.

(5) Violet Colorants

Manganese Violet, Fast Violet R, Methyl Violet Lake, etc.

(6) Blue Colorants

Prussian Blue, cobalt blue, Alkali Blue Lake, Victoria Blue Lake, Phthalocyanine Blue, metal-free Phthalocyanine Blue, partially-chlorinated Phthalocyanine Blue, Fast Sky Blue, Indanthrene Blue BC, etc.

(7) Green Colorants

Chromium oxide, chromium oxide, Pigment Green B, Malachite Green Lake, Final Yellow Green G, etc.

(8) White Colorants

Zinc oxide, titanium oxide, antimony oxide, zinc sulfide, etc.

(9) Body Colorants

Barite, barium carbonate, clay, silica, white carbon, talc, alumina white, etc.

(10) Dye Colorants

Basic dyes, acidic dyes, dispersing dyes, and direct dyes can also be used as colorants.

Specific examples of the dyes include Nigrosine, Methylene Blue, Rose Bengal, Quinoline Yellow, ultramarine blue, etc.

These colorants can be used alone or in combination. The content of a colorant in a toner is from 1 to 20 parts by weight, and preferably from 2 to 10 parts by weight, per 100 parts by weight of the binder resin included in the toner. When the content is too low, the resultant image has low image density. In contrast, when the content is too high, the resultant toner has poor fixability.

When the toner is used as a translucent color toner, the following pigments and dyes can be used.

(1) Yellow Colorants

C.I. (color index) 10316 (Naphthol Yellow S), C.I. 11710 (Hansa Yellow 10G), C.I. 11660 (Hansa Yellow 5G), C.I. 11670 (Hansa Yellow 3G), C.I. 11680 (Hansa Yellow G), C.I. 11730 (Hansa Yellow GR), C.I. 11735 (Hansa Yellow A), C.I. 11740 (Hansa Yellow RN), C.I. 12710 (Hansa Yellow R), C.I. 12720 (Pigment Yellow L), C.I. 21090 (Benzidine Yellow), C.I. 21095 (Benzidine Yellow G), C.I. 21100 (Benzidine Yellow GR), C.I. 20040 (Permanet Yellow NC), C.I. 21220 (Vulcan First Yellow R), etc.

(2) Red Colorants

C.I. 12055, C.I. 12075 (Permanent Orange), C.I. 12175 (Lithol Fast Orange 3GL), C.I. 12305 (Permanent Orange GTR), C.I. 11725 (Hansa Yellow 3R), C.I. 21165 (Vulcan Fast Orange GG), C.I. 21110 (Benzidine Orange G), C.I. 12120 (Permanent Red 4R), C.I. 12070 (Para Red), C.I. 12085 (Fire Red), C.I. 12315 (Brilliant Fast Scarlet), C.I. 12310 (Permanent Red F2R), C.I. 12335 (Permanent Red F4R), C.I. 12440 (Permanent Red FRL), C.I. 12460 (Permanent Red FRLL), C.I. 12420 (Permanent Red F4RH), C.I. 12450 (Light Fast Red Toner B), C.I. 12490 (Permanent Carmine FB), C.I. 15850 (Brilliant Carmine 6B), etc.

(3) Blue Colorants

C.I. 74100 (metal-free phthalocyanine blue), C.I. 74160 (phthalocyanine blue), C.I. 74180 (Fast Sky Blue), etc.

These colorants can be used alone or in combination. The content of the colorant in the toner is from 1 to 10 parts by weight, and preferably from 2 to 5 parts by weight, per 100 parts by weight of the binder resin included in the toner. When the content is too low, the resultant image has low image density. In contrast, when the content is too high, the resultant toner has poor fixability and low translucency.

Release Agent

The toner for use in the present invention include a release agent. Suitable release agents include known release agents (i.e., offset preventing agents).

Specific examples of the release agents include low molecular weight polyethylene waxes, low molecular weight oxidized polyethylene waxes, low molecular weight polypropylene waxes, low molecular weight oxidized polypropylene waxes, candelilla waxes, carnauba waxes, rice waxes, montan waxes and derivatives thereof, paraffin waxes and derivatives thereof, microcrystalline waxes and derivatives thereof, SASOL waxes and oxidized SASOL waxes, hardened caster oil and derivatives thereof, 12-hydroxylstearic acid, higher fatty acid waxes, higher fatty acid ester waxes, etc.

These release agents can be used alone or in combination. The content of a release agent in a toner is from 1 to 10 parts by weight, and preferably from 2 to 5 parts by weight, per 100 parts by weight of the binder resin included in the toner when the toner is used for oil-less heat roller fixing devices.

When the content is too low, the resultant toner has poor fixability. In contrast, when the content is too high, the resultant toner has poor fixability and charging ability. When the toner is used for fixers other than oil-less heat roller fixing devices, the content of the release agent is not particularly limited.

Magnetic Powder

The toner for use in the present invention may include a magnetic powder. Suitable magnetic materials include known magnetic materials used in conventional toners.

Specific examples of the magnetic powders include metals, metal alloys, oxides and ferrites of aluminum, cobalt, iron, lead, magnesium, nickel, zinc, antimony, beryllium, bismuth, cadmium, calcium manganese, selenium, titanium, tungsten, vanadium, etc.

These magnetic materials can be used alone or in combination. The content of a magnetic powder in a toner is from 1 to 80 parts by weight, and preferably from 5 to 60 parts by weight, per 100 parts by weight of the binder resin included in the toner. When the content is too low, the functions of the magnetic powder cannot be fulfilled. In contrast, when the content is too high, the resultant toner has poor charging property.

Charge Controlling Agent

The toner for use in the present invention preferably includes a charge controlling agent. Suitable charge controlling agents include known charge controlling agents used for use in conventional toners.

Specific examples of the negative charge controlling agents include chromium-containing complex salt based azo dyes such as S-32, 33, 34, 35, 37, 38 and 40 (from Orient Chemical Industries co., Ltd.); AIZEN SPIRON BLACK TRH and BHH (from Hodogaya Chemical Co., Ltd.); KAYASET BLACK T-22 and 004 (from Nippon Kayaku Co., Ltd.); copper phthalocyanine based dyes S-39 (from Orient Chemical Industries co., Ltd.); zinc-containing complex salts E-84 (from Orient Chemical Industries co., Ltd.); aluminum-containing complex salts E-86 (from Orient Chemical Industries co., Ltd.); and calixarene based compounds.

Specific examples of the positive charge controlling agents include BONTRON N-01 and BONTRON P-51 (from Orient Chemical Industries co., Ltd.); and imidazole based compounds.

When charge controlling agents having a large particle diameter are used, the charge controlling agents are preferably pulverized so as to have a desired particle diameter.

External Additive

The toner for use in the present invention may include an external additive. Suitable materials for use as the external additive include known external additives for use in conventional toners.

Specific examples thereof include inorganic particulate materials, e.g., hydrophobizedcarbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, and diamond carborundum; nitrides such as boron nitride, titanium nitride, and zirconium nitride; hydrophobized borides such as zirconium boride; hydrophobized oxides such as aluminum oxide, titanium oxide, iron oxide, chromium oxide, calcium oxide, magnesium oxide, zinc oxide, copper oxide, and silica; sulfides such as molybdenum sulfide; hydrophobized fluorides such as magnesium fluoride, and carbon fluoride; metal soaps such as aluminum stearate, calcium stearate, zinc stearate, and magnesium stearate; talc; bentonite; and metals and metal alloys of cobalt, iron, nickel, aluminum, lead, magnesium, zinc, antimony, beryllium, bismuth, cadmium, calcium, manganese, selenium, titanium, tungsten, vanadium, etc.

In addition, organic particulate materials such as styrene resins, (meth)acrylic resins, olefin resins, fluorine-containing (meth)acrylic resins, nitrogen-containing (meth)acrylic resins, epoxy resins, silicone resins, benzoguanamine resins, melamine resins, and copolymers thereof can also be used as the external additive.

The content of an external additive in a toner is from 0.01 to 5 parts by weight, and preferably from 0.1 to 3 parts by weight, per 100 parts by weight of the toner. When the content is too low, the functions of the external additive cannot be fulfilled. In contrast, when the content is too high, the resultant toner has poor fluidity.

Method for Manufacturing Toner

The toner for use in the present invention can be prepared by any known methods.

Specific examples of the methods include pulverization methods; polymerization methods such as emulsion polymerization methods and suspension polymerization methods; liquid granulating methods such as emulsion granulating methods and spray drying methods; and microcapsule methods.

The particle diameter of the toner is generally from 3 to 20 μm, preferably from 4 to 15 μm, and more preferably from 6 to 12 μm. When the particle diameter is too small, the resultant toner tends to have poor charging property and fluidity, and thereby background fouling tends to occur in the resultant images. In contrast, when the particle diameter is too large, high quality images cannot be produced.

Removing Agent (i.e., Adhesive Force Decreasing Agent)

Suitable materials for use as the removing agent, which decreases the adhesive force of the image to an image support when heated, include any materials which can melt when heated and exude from the toner to locate between the image and the image support when heated, thereby decreasing the adhesive force of the image (i.e., the adhesive force is decreased after the second heating), or any materials which can be present at an interface between the image and the image support when the image is fixed on the image support, thereby decreasing the adhesive force of the image to the image support (i.e., the adhesive force is decreased after the image is fixed).

When the image forming material (i.e., the toner) is lipophilic, a removing agent having a hydrophilic group is preferably used. When such a removing agent is used, the removing agent exudes from the toner when the toner is melted because the removing agent has poor affinity for the toner. In this case, when the image support is a material having a hydrophilic group, such as cellulose, the hydrophilic group of the removing agent has a hydrogen bonding with the image support, and thereby the removing agent remains at an interface between the image and the image support without penetrating into the image support. Therefore, the adhesion force of the image to the image support can be effectively reduced, and thereby the image can be well removed.

When each of the image and the thermoplastic resin of the removing member have a lipophilic group therein, a material having both a hydrophilic group and a lipophilic group is preferably used. This is because the compatibility of the removing agent with the image and the image support is improved, and thereby the removing agent can be easily removed from the image support together with the image while the above-mentioned effect of the hydrophilic group can be exerted. Therefore, when the image support is reused, occurrence of a removing agent-induced problem in that the image cannot be well fixed on the image support due to the removing agent remaining in the image support can be prevented.

Suitable materials for use as the removing material include compounds having both a hydrophilic group (e.g., a carboxylic acid group, a hydroxycarboxylic acid group, a sulfonic acid group, a phosphonic acid group, a phosphinic acid group, a hydroxyl group, and a quaternary ammonium group) and a lipophilic group such as hydrocarbon groups (e.g., n-alkyl groups, branched alkyl groups, aromatic alkyl groups, partially-fluorinated alkyl groups, and perfectly-fluorinated alkyl groups). These compounds can be used alone or in combination.

Specific examples of the removing agents include the following but are not limited thereto:

$C_{17}H_{35}PO_3H_2$, $C_{16}H_{32}$Diol, $C_{21}H_{43}COOH$, $C_{18}H_{37}NH_2$, $(C_{18}H_{37})PO_2H$, $(OH)_3ArCOOC_{18}H_{37}$, $C_{12}H_{25}PO_3H$, $C_{10}H_{21}OPO_3H_2$, $C_{21}H_{23}COOH$, $CH_3(CH)_{15}CHOHCOOH$, $C_9F_{19}COOH$, $HF_2C(CF_2)_8COOH$, $CH_3(CH)_{11}CHOHCHOH$, $CH_3(CH)_{15}SO_3HCHCOOR$, and $CH_3(CH_2)_{15}(CH_3)_3NX$.

The removing agent can be added to an image forming material as an external additive or an internal additive. However, it is preferable that the removing agent is added as an external additive because good removing effect can be exerted even when the addition amount of the removing agent is relatively small. The same is true for the case in which the removing agent is added to a particulate material.

External addition means that a removing agent is adhered or fixed to a surface of an image forming material such as toner particles. Specific examples of the external addition method include a method in which a removing agent is adhered or fixed to image forming particles (such as toner particles) using a surface reforming machine such as hybridization machines and ONG MILL, and a mixer such as HENSCHEL MIXER and Hi-X.

In contrast, internal addition means that a removing agent is added to an image forming material such as toner particles such that the removing agent is uniformly included in the image forming material, i.e., any part of the image forming material includes the removing agent similarly. In this case, it is preferable that the removing agent is included in the surface portion of the image forming material in a relatively large amount compared to that in inside portion thereof.

Specific examples of the internal addition method include a method in which a removing agent is mixed with other constituents of the image forming material (such as resins, colorants, waxes, and charge controlling agents), and the mixture is kneaded, pulverized and classified; and a method in which a mixture of a removing agent and constituents of the image forming material is emulsified to form particles of the mixture.

In addition, when a particulate resin is prepared by a suspension polymerization method to prepare a toner, a removing agent can be mixed with the monomers for the resin.

The content of the removing agent is not particularly limited, but is preferably as follows:

When a removing agent is added as an external additive, the content of the removing agent is from 1 to 50% by weight, and preferably from 5 to 20% by weight, based on total weight of the removing agent and the constituents (e.g., abinder resin, a colorant and other additives) of the image forming material. When the content is too low, the desired function of decreasing adhesive force cannot be well performed. In contrast, when the content is too high, the adhesive force decreasing function is excessively performed, and thereby a problem in that the image is not well fixed occurs.

When a removing agent is added as an internal additive, the content of the removing agent is from 5 to 75% by weight, and preferably from 10 to 30% by weight, based on total weight of the removing agent and the constituents (e.g., abinder resin, a colorant and other additives) of the image forming material. When the content is too low, the desired function of decreasing adhesive force cannot be well performed. In contrast, when the content is too high, the adhesive force decreasing function is excessively performed, and thereby a problem in that the image is not well fixed occurs.

Particulate Material

Specific examples of the particulate materials to which a removing agent is added or which serves as a clathrate including a removing agent therein are the following, but are not limited thereto.

(1) Inorganic Particulate Materials

Hydrophobized carbides such as silicon carbide, boron carbide, titanium carbide, zirconium carbide, hafnium carbide, vanadium carbide, tantalum carbide, niobium carbide, tungsten carbide, chromiumcarbide, molybdenumcarbide, calcium carbide, and diamond carborundum; nitrides such as boron nitride, titanium nitride, and zirconium nitride; hydrophobizedborides such as zirconium boride; hydrophobized oxides such as aluminum oxide, titanium oxide, iron oxide, chromium oxide, calcium oxide, magnesium oxide, zinc oxide, copper oxide, and silica; sulfides such as molybdenum sulfide; hydrophobized fluorides such as magnesium fluoride, and carbon fluoride; metal soaps such as aluminum stearate, calcium stearate, zinc stearate, and magnesium stearate; talc; bentonite; and metals and metal alloys of cobalt, iron, nickel, aluminum, lead, magnesium, zinc, antimony, beryllium, bismuth, cadmium, calcium, manganese, selenium, titanium, tungsten, vanadium, etc.

(2) Organic Particulate Materials

Polymers or copolymers which are prepared by a wet polymerization method such as emulsion methods, soap-free emulsion methods and non-aqueous dispersion polymerization methods or a gas phase polymerization method, such as styrene resins, (meth)acrylic resins, olefin resins, fluorine-containing (meth)acrylic resins, nitrogen-containing (meth) acrylic resins, epoxy resins, silicone resins, benzoguanamine resins, melamine resins; natural polymers such as starches (e.g., sugar cane starch, potatostarch, tapioca starch, wheat starch, and corn starch), mannan, seaweed polymers (e.g., gelatin and sodium alginate), vegetable polymers (e.g., Hibiscus manihot, tragacanth gum and gum arabic), microbial polymers (e.g., dextran and levan), and proteins (e.g., glue, gelatin, casein and collagen); semi-synthetic polymers such as celluloses (e.g., viscose, methyl cellulose, ethyl cellulose, hydroxyethyl cellulose and carboxymethyl cellulose), and starches (e.g., amylogen, carboxymethyl starch and dialdehyde starch); and synthetic polymers (e.g., polyvinyl alcohol, polyacrylic acid sodium salt, poly-N-vinyl acetoamide, polyacrylic acid, polyacrylamide, polyethylene oxide and isobutylene-maleic abhydride) and copolymers of these resins.

These materials can be used alone or in combination.

It is preferable that the particulate material has a hydrophilic group which can form an ion bonding or a hydrogen bonding with the removing agent used, or the particulate material is a clathrate capable of including the removing agent in the space therein.

More preferably, clathrates are used as the particulate material. When the particulate material is a clathrate, a large amount of removing agent can be included therein. In addition, the removing agent in the clathrate hardly releases therefrom because of being captured by the clathrate, and thereby an adhesive force decreasing problem is hardly caused. Further, when the clathrate is heated, the removing agent therein is easily released therefrom.

When a particulate material having a hydrophilic group is merely used, the material has a poor moisture resistance, resulting in occurrence of a problem such that particles of the material agglomerate during preservation, although the particulate material has an ability to well release a removing agent. If the addition amount of the combination of a removing agent and a particulate material is reduced to prevent occurrence of this problem, another problem in that the desired removing effect cannot be produced occurs. Therefore, this measure is not preferable.

In contrast, in the present invention, the hydrophilic groups of a particulate material and a removing agent are allowed to form an ionic bonding or a hydrogen bonding to suppress the function of the hydrophilic groups, resulting in improvement of the moisture resistance. In addition, when the combination of a particulate material and a removing agent is heated to remove an image, the bonding is weakened or released, and thereby the adhesion force decreasing effect can be well exerted. Thus, the problem caused by hydrophilic groups can be solved.

In order to suppress the function of a hydrophilic group of a particulate material, it is preferable to use a removing agent having both a group capable of forming an ionic bonding or a hydrogen bonding with a hydrophilic group of the particulate material and a lipophilic group such as alkyl groups. Suitable groups for use as the group forming a hydrogen bonding include groups in which a group such as alcohol groups (including a diol, etc.), carboxyl groups, ester groups, ether groups, amide groups and benzene carboxylic acid groups is connected with a lipophilic group such as alkyl groups.

In addition, it is preferable that the removing agent includes a lipophilic group including a dialkyl group or a lipophilic group including at least one benzene ring because contact between particles of the particulate material or contact between the particulate material and the image forming material can be prevented due to steric effect of the long chain group.

In order to add a removing agent to a particulate material or include a removing agent in a particulate material to form a clathrate, known reforming methods can be used. An example of the method is as follows.

A particulate material is dispersed in a poor solvent such as toluene. A predetermined amount of removing agent which can form a chemical bonding with an acid group is added to the dispersion. The mixture is heated for several hours at a temperature of from 90 to 95° C. using a water bath to perform a reaction. Then the reaction product is transferred to a flask and the poor solvent is removed therefrom by distillation at a reduced pressure using an aspirator. The thus prepared solid-state reaction product is optionally dissociated using a mixer to prepare a desired particulate material.

The weight ratio of the removing agent in the particulate material is not particularly limited, but is preferably from 10 to 90% by weight based on total weight of the removing agent and the particulate material.

When the ratio is too low, the desired function of decreasing adhesive force cannot be well performed. In contrast, when the ratio is too high, the adhesive force decreasing function is excessively performed, and thereby a problem in that the image is not well fixed occurs.

When a particulate material to which a removing agent is added is added to an image forming material as an external additive, the content of the particulate material is from 1 to 50% by weight, and preferably from 5 to 30% by weight, based on total weight of the particulate material and the constituents (e.g., a binder resin, a colorant and other additives) of the image forming material.

When such a particulate material is added as an internal additive, the content of the particulate material is from 5 to 75% by weight, and preferably from 10 to 40% by weight, based on total weight of the particulate material and the constituents (e.g., a binder resin, a colorant and other additives) of the image forming material.

When the content is too low, the desired function of decreasing adhesive force cannot be well performed. In contrast, when the content is too high, the adhesive force decreasing function is excessively performed, and thereby a problem in that the image is not well fixed occurs.

Substrate

Then the substrate of the removing member on which an outermost layer is to be formed will be explained.

Specific examples of the substrate include rollers and films. The substrate has an outermost layer including a thermoplastic resin. Suitable materials for use as the substrate include heat-resistant resin films and metals such as aluminum, copper, nickel and iron, but are not limited thereto.

As the resin films, water-soluble resin films and water-insoluble films can be used. The outermost layer may be adhered to the substrate with an adhesive. In addition, the resin film may be a thermoplastic resin film on which an outermost layer is not formed.

Specific examples of the materials for use in the substrate and the adhesives include protein compounds such as glue, gelatin, albumin and casein; carbohydrate compounds such as starches, celluloses and complex polysaccharides (e.g., gum arabic and tragacanth gum); thermoplastic resins such as vinyl acetate polymers and copolymers, acrylic polymers and copolymers, ethylene copolymers, polyamides, polyesters and polyurethanes; rubbers such as polychloroprene rubbers, nitrile rubbers, camelback, SBR rubbers and natural rubbers; pressure-sensitive materials such as rubbers and acrylic resins; and thermoplastic resins such as vinyl acetate polymers and copolymers, acrylic polymers and copolymers, ethylene copolymers, polyamides, styrene-acrylic resins, styrene resins, (meth)acrylic resins, olefin resins, polyester resins, amide resins, polycarbonate resins, polyether resins, polysulfone resins, epoxy resins, urea resins, urethane resins, copolymers of these resins and mixtures of these resins.

It is preferable that the substrate has affinity for the image forming material (e.g., a toner).

In addition, films in which titanium oxide is dispersed in a polyethylene terephthalate, and films of resins such as polyether ether ketone polysulfone, polyether sulfone, polyether imide, polyethylene terephthalate and aromatic polyamide films, can also be used as the substrate.

Thermoplastic Resins

Suitable thermoplastic resins for use in the outermost layer of the removing member include thermoplastic resins for use as a toner binder.

Specific examples of the thermoplastic resins include thermoplastic polymers and copolymers such as styrene-acrylic resins, styrene resins, (meth)acrylic resins, olefin resins, polyester resins, amide resins, polycarbonate resins, polyether resins, polysulfone resins, epoxy resins, urea resins, and urethane resins, but are not limited thereto.

Image Removing Device

The image removing device of the present invention will be explained referring to drawing.

FIG. 1 is a schematic view illustrating the cross section of an example of the image removing device of the present invention.

Referring to FIG. 1, an image support 1 on which an image consisting of an image forming material have been formed is fed from a tray 2, and is fed into an image removing device 100 by a pair of feeding rollers 3 and 3 along a guide plate 4.

An image removing member 10 is rotated while supported by a heat feed roller 8 including a heater 7 therein, support rollers 9*a* and 9*b*, and an elastic roller 14. The image removing member 10 includes a polyether ether ketone having a thickness of 100 μm (SUMILITE FS-1100C from Sumitomo Bakelite Co., Ltd.) (hereinafter referred to as a PEEK film), and an outermost layer which is formed on the PEEK film by applying a thermoplastic resin or a material including a thermoplastic resin.

The image support 1 is fed through a nip between the image removing member 10 and a roller 11 while heated so that the image on the image support is transferred to the image removing member 10 (i.e., the outermost layer).

A thermometric element 13 is provided on the heat feed roller 8 to measure and control the temperature of the heat feed roller 8.

If the heat feed roller 8 is replaced with a fixing roller which is used for normal copiers, the image removing device 100 can be used as an image fixing device.

Thus, the image on the image support 1 is transferred to the image removing member 10, and the image support, which can be reused, is discharged from the image removing device 100.

A pressure roller 12 presses the removing member 10 so that the removing member 10 is stretched.

Figure 2:
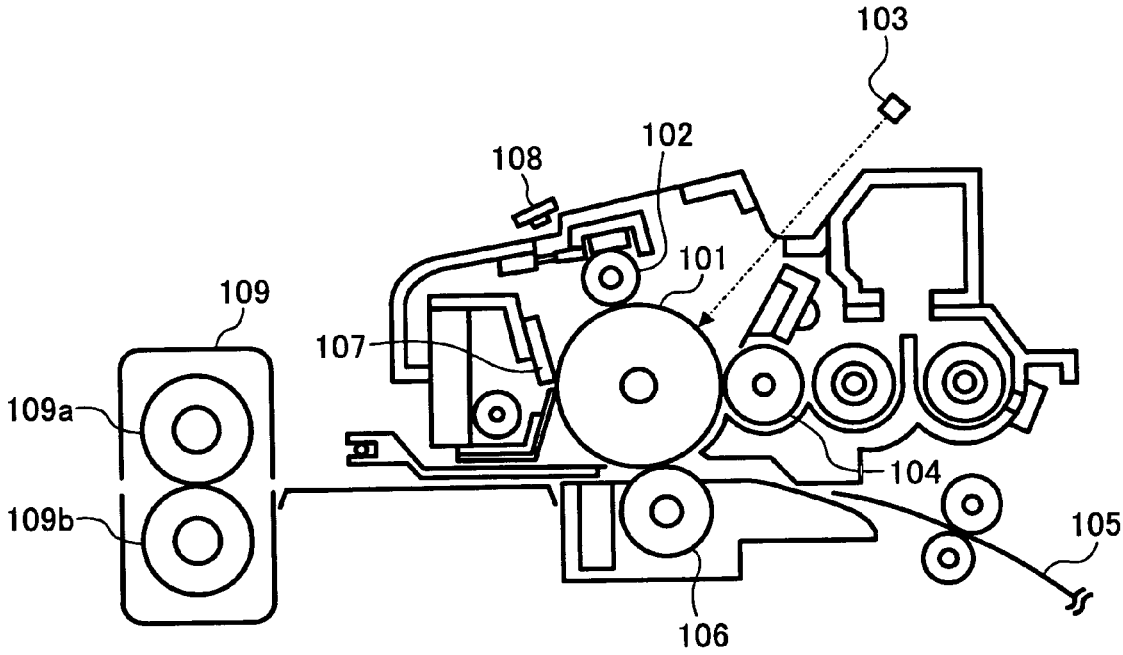
FIG. 2 is a schematic view illustrating the main part of an embodiment of the image forming apparatus of the present invention.

Then the image forming apparatus of the present invention will be explained referring to FIG. 2. In FIG. 2, numeral 101 denotes the photoreceptor serving as an image bearing member. Around the photoreceptor 101, a charger 102 configured to charge the photoreceptor 101; an imagewise light irradiator 103 configured to irradiate the photoreceptor 101 with imagewise light to form an electrostatic latent image on the photoreceptor 101; an image developer 104 configured to develop the electrostatic latent image with a developer including a toner to form a toner image on the photoreceptor 101; an image transfer device 106 configured to transfer the toner image on an image support 105 such as paper; a cleaner 107 configured to remove the residual toner on the photoreceptor 101; and a discharge lamp 108 configured to remove the residual potential remaining on the photoreceptor 101, are arranged. Numeral 109 denotes a fixer configured to fix the toner image on the image support upon application of heat thereto, resulting in formation of a hard copy. The fixer includes a fixing roller 109*a* and a pressure roller 109*b*.

The image forming apparatus may further include the image removing device as illustrated in FIG. 1.

Figure 3A:
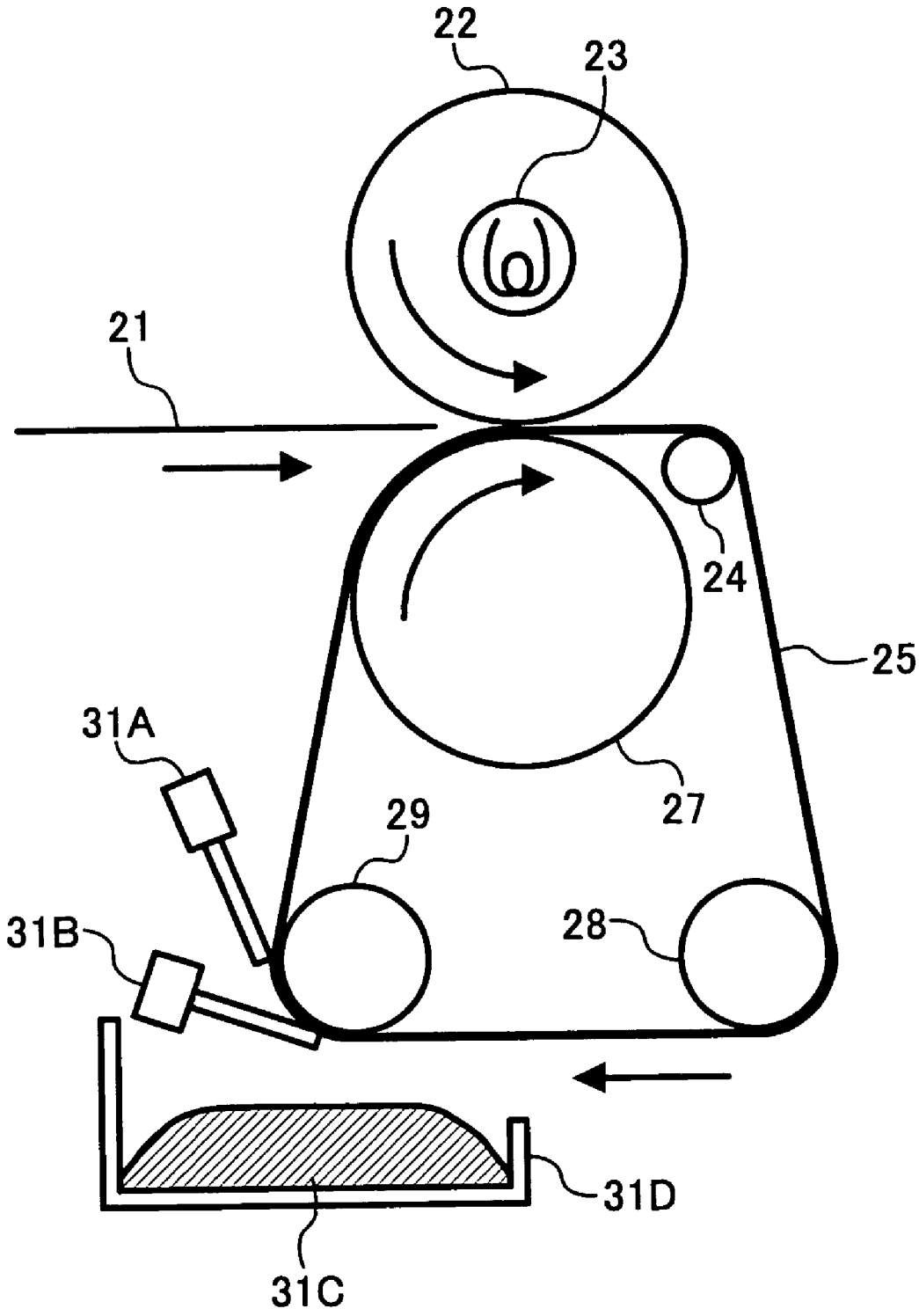
FIGS. 3A and 3B are schematic views illustrating the main parts of embodiments of the device for renewing the image removing member for use in the present invention.
Figure 3B:
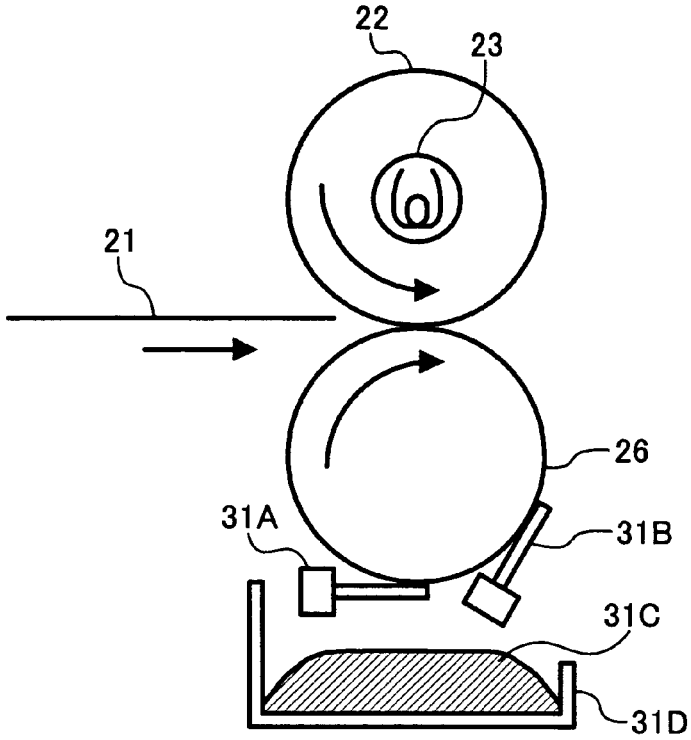

FIGS. 3A and 3B are schematic views illustrating the main parts of embodiments of the image removing device of the present invention including a device configured to renew the outermost layer (hereinafter referred to as an image removing member renewing device) for use in the present invention.

Referring to FIG. 3A, an image support (paper) 21 having an image thereon is fed into a nip between a heat roller 22 having a halogen lamp 23 therein and a pressure roller 27 such that the image is contacted with an image removing member 25 having an endless belt form. Thus, the image on the image support 21 is transferred to the image removing member 25. The image support is separated from the image removing member 25 at a separating roller 14. The image removing member 25 is rotated in a direction indicated by an arrow while tightly stretched by rollers 28 and 29 and the separating roller 24. The image adhered to the surface of the image removing member 25 is scraped off blades 31A and 31B. The thus scraped image forming material is contained in a container 31D as a waste material. In addition, the image removing member from which the image is removed can be used for next image removing operation.

The image scraping operation is not necessarily performed whenever the image is adhered to the image removing member 25. When the image forming material is a thermoplastic resin, the image forming material adhered to the surface of the image removing member is considered to be a part of the outermost layer of a part of the image removing member.

In the image removing device illustrated in FIG. 3B, the image removing member is a roller 26.

The image removing member renewing device is not limited to the devices illustrated in FIGS. 3A and 3B.

Figure 4:
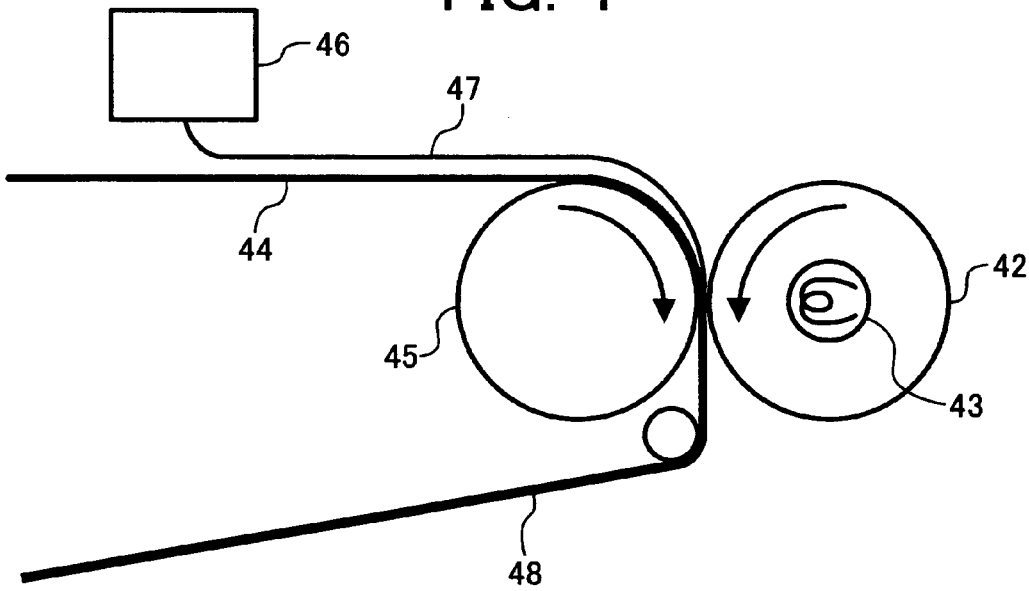
FIG. 4 is a schematic view illustrating the main part of the device for forming an outermost layer on an image removing member for use in the present invention.

FIG. 4 is a schematic view illustrating the main part of a device forming an outermost layer on an image removing member for use in the image removing device and image forming apparatus of the present invention. The device is hereinafter referred to as image removing member forming device.

Referring to FIG. 4, a thermoplastic resin supplier 46 supplies a thermoplastic resin 47 on a substrate 44 of an image removing member. The thermoplastic resin 47 on the substrate 44 is nipped by a heat roller 42 having a halogen lamp 43 therein and a pressure roller 45 upon application of heat thereto. Thus, an outermost layer is formed on the substrate 44, resulting in formation of an image removing member.

The constitution of the thermoplastic resin supplier 46 is not particularly limited, and for example, an image transfer device of an image forming apparatus can be used as the thermoplastic resin supplier 46. In addition, the constitution of the device for fixing the thermoplastic resin on the substrate 44 is not particularly limited thereto, and a fixing device of an image forming apparatus and an image removing device can also serve as the device.

The image removing member forming device is not limited to the devices illustrated in FIG. 4.

Having generally described this invention, further understanding can be obtained by reference to certain specific examples which are provided herein for the purpose of illustration only and are not intended to be limiting.

EXAMPLES

Example 1

Preparation of Image Removing Member

The toner mentioned below for use in developing a latent image, which toner includes a polyester resin as a main component, was adhered to the PEEK film mentioned above using an adhesive. Thus, an image removing member was prepared.

Preparation of Toner Image

A toner image was formed on an image support paper, PPC PAPER TYPE 6200 manufactured by Ricoh Co., Ltd., using an image forming apparatus having a constitution illustrated in FIG. 2 and a toner which is IMAGIO TONER TYPE 18 and which includes the same materials as used for the outermost layer of the removing member and which additionally includes a removing agent, $C_{12}H_{25}PO_3H$, as an internal additive.

The image forming conditions were as follows:

Temperature of fixing roller: about 130° C.

Paper feeding speed: 30 mm/sec

Image density of toner image: 1.2

Removal of Toner Image

The toner image on the image support paper was removed using the image removing device having a constitution illustrated in FIG. 1. The image removing conditions were as follows:

Temperature of heat feed roller 8: about 140° C.

Paper feeding speed: about 30 mm/sec

Evaluation

Removing Property

After the image removing operation, the image support paper was observed to determine whether the image is clearly removed from the image support paper. The evaluation of the image removing quality is performed by classifying into the following five grades:

Rank 5: Entire the image is perfectly removed.

Rank 4: Almost entire the image is removed but a very small part of the image remains without being removed.

Rank 3: A small part of the image remains without being removed.

Rank 2: A large part of the image remains without being removed.

Rank 1: The image is hardly removed.

X: The paper is broken, and therefore the paper cannot be reused.

Preservability of Image

The toner image was subjected to a preservation test for 24 hours at 24° C. 65% RH. The preservability was evaluated as follows:

Rank 5: The toner image has good preservability.

Rank 3: The preservability is on an acceptable level.

Rank 1: The preservability is on an unacceptable level.

The evaluation results are shown in Table 1.

Example 2

The procedure for preparation and removal of the toner image in Example 1 was repeated except that the removing agent was added to the toner as an external additive.

The evaluation results are shown in Table 1.

Example 3

The procedure for preparation and removal of the toner image in Example 1 was repeated except that the removing agent was replaced with a removing agent, $C_{17}H_{35}PO_3H_2$, and a combination of the removing agent and a particulate material (i.e., an ethylene (85%)-methyl methacrylate (15%) copolymer), in which the removing agent has been added to the particulate material, was added to toner as an internal additive.

The evaluation results are shown in Table 1.

Example 4

The procedure for preparation and removal of the toner image in Example 1 was repeated except that the removing agent was replaced with a removing agent, $C_{17}H_{35}PO_3H_2$, and a combination of the removing agent and a particulate material (i.e., a polyacrylic acid), in which the removing agent had been added to the particulate material, was added to the toner as an external additive.

The evaluation results are shown in Table 1.

Example 5

The procedure for preparation and removal of the toner image in Example 1 was repeated except that the removing agent was replaced with a removing agent, $C_{17}H_{35}PO_3H_2$, and a combination of the removing agent and a particulate material (i.e., a hollow silica), which is a clathrate in which the hollow silica includes the removing agent therein, was added to the toner as an internal additive.

The evaluation results are shown in Table 1.

Example 6

The procedure for preparation and removal of the toner image in Example 1 was repeated except that the removing agent was replaced with a removing agent, $C_{17}H_{35}PO_3H_2$, and a combination of the removing agent and a particulate material (i.e., a hollow silica), which is a clathrate in which the hollow silica includes the removing agent therein, was added to the toner as an external additive.

The results are shown in Table 1.

Example 7

The procedure for preparation and removal of the toner image in Example 1 was repeated except that the removing agent was replaced with a removing agent, $C_{18}H_{37}NH_2$, and a combination of the removing agent and a particulate material (i.e., polyacrylic acid), in which the particulate material and the removing agent form an ion bonding, was added to the toner as an external additive.

The evaluation results are shown in Table 1.

Example 8

The procedure for preparation and removal of the toner image in Example 1 was repeated except that the removing agent was replaced with a removing agent, $C_{17}H_{35}PO_3H_2$, and a combination of the removing agent and a particulate material (i.e., polyacrylic acid), in which the particulate material and the removing agent form a hydrogen bonding, was added to the toner as an external additive.

The evaluation results are shown in Table 1.

Example 9

The procedure for preparation and removal of the toner image in Example 1 was repeated except that the removing agent was added to the toner as an external additive, and the material of the outermost layer was changed to a styrene-acrylic resin.

The evaluation results are shown in Table 1.

Example 10

The procedure for preparation and removal of the toner image in Example 2 was repeated except that the toner layer (i.e., the outermost layer) was formed by heating the toner without using the adhesive.

The evaluation results are shown in Table 1.

Comparative Example 1

The procedure for preparation and removal of the toner image in Example 1 was repeated except that the outermost layer was not formed and the removing agent was not included in the toner.

The results are shown in Table 1.

Comparative Example 2

The procedure for preparation and removal of the toner image in Comparative Example 1 was repeated except that a removing agent, $C_{12}H_{25}PO_3H$, was added to the toner as an external additive.

The results are shown in Table 1.

Comparative Example 3

The procedure for preparation and removal of the toner image in Example 1 was repeated except that the removing agent, $C_{12}H_{25}PO_3H$, was not added to the toner.

The results are shown in Table 1.

TABLE 1

| | Removing property | Preservability |
|---|---|---|
| Example 1 | Rank 4 | Rank 3 |
| Example 2 | Rank 5 | Rank 3 |
| Example 3 | Rank 5 | Rank 3 |
| Example 4 | Rank 5 | Rank 3 |
| Example 5 | Rank 5 | Rank 5 |
| Example 6 | Rank 5 | Rank 5 |
| Example 7 | Rank 5 | Rank 5 |
| Example 8 | Rank 5 | Rank 5 |
| Example 9 | Rank 4 | Rank 3 |
| Example 10 | Rank 5 | Rank 3 |
| Comparative Example 1 | Rank 1 | Rank 5 |
| Comparative Example 2 | Rank 2 | Rank 3 |
| Comparative Example 3 | X | Rank 5 |

As can be understood from Table 1, toner images can be clearly removed by the image removing method of the present invention. In particular, when the methods of Examples 5 to 8 are used, toner images can be clearly removed while the toner image has good preservability.

This document claims priority and contains subject matter related to Japanese Patent Application No. 2002-292063, filed on Oct. 4, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image removing method comprising:

bringing an outermost layer of an image removing member into contact with an image fixed on an image support without applying a liquid to the image, while heating the image and the image removing member; and separating the removing member from the image support to remove the image from the image support, wherein the removing member comprises a substrate and the outermost layer which is located overlying the substrate and which comprises a thermoplastic resin, and wherein the image comprises a removing agent which can decrease adhesion force of the image to the image support when heated.

2. The image removing method according to claim 1, wherein the image further comprises a second thermoplastic resin.

3. The image removing method according to claim 2, wherein the second thermoplastic resin in the image is the same as the thermoplastic resin in the outermost layer.

4. The image removing method according to claim 1, wherein the image and the outermost layer further comprise a same material.

5. The image removing method according to claim 1, wherein the outermost layer is fixed on the substrate upon application of heat thereto.

6. The image removing method according to claim 1, wherein the image further comprises a material having a lipophilic group therein.

7. The image removing method according to claim 1, wherein the image further comprises a particulate material having a hydrophilic group, wherein the removing agent comprises a hydrophilic group, and wherein the hydrophilic groups of the particulate material and the removing agent have an ionic bonding.

8. The image removing method according to claim 1, wherein the image further comprises a particulate material having a hydrophilic group, wherein the removing agent comprises a hydrophilic group, and wherein the hydrophilic groups of the particulate material and the removing agent have a hydrogen bonding.

9. The image removing method according to claim 1, wherein a temperature at which the image is heated to be removed is higher than a fixing temperature at which the image is fixed on the image support.

* * * * *